United States Patent [19]

Stamm

[11] 3,995,422

[45] Dec. 7, 1976

[54] COMBUSTOR LINER STRUCTURE

[75] Inventor: Edward I. Stamm, Cincinnati, Ohio

[73] Assignee: General Electric Company, Cincinnati, Ohio

[22] Filed: May 21, 1975

[21] Appl. No.: 579,309

[52] U.S. Cl. ..... 60/39.66
[51] Int. Cl.[2] ..... F02C 7/18
[58] Field of Search ..... 60/39.65, 39.66

[56] References Cited

UNITED STATES PATENTS

| | | | |
|---|---|---|---|
| 3,064,424 | 11/1962 | Tomlinson | 60/39.66 |
| 3,184,918 | 5/1965 | Mulcahey | 60/39.66 |
| 3,362,470 | 1/1968 | Richardson | 60/39.65 |
| 3,520,134 | 7/1970 | Cripe et al. | 60/39.65 |
| 3,643,430 | 2/1972 | Emory et al. | 60/39.65 |
| 3,745,766 | 7/1973 | Melconian | 60/39.65 |
| 3,845,620 | 11/1974 | Kenworthy | 60/39.66 |
| 3,899,876 | 8/1975 | Williamson | 60/39.66 |

FOREIGN PATENTS OR APPLICATIONS

| | | | |
|---|---|---|---|
| 2,054,002 | 4/1972 | Germany | 60/39.66 |
| 685,062 | 12/1952 | United Kingdom | 60/39.65 |
| 1,060,097 | 2/1967 | United Kingdom | 60/39.66 |

*Primary Examiner*—Carlton R. Croyle
*Assistant Examiner*—Robert E. Garrett
*Attorney, Agent, or Firm*—Dana F. Bigelow; Derek P. Lawrence

[57] ABSTRACT

An air-cooled combustor liner is constructed of a continuous, constant-thickness, annular shell having a plurality of rings attached to the inner surface thereof to direct the flow of coolant air entering the shell by way of apertures formed therein, along the inner surface of the shell to provide a film cooling function. The rings, which are fabricated to desired dimensions sufficient to prevent significant thermal distortion which would cause flow restriction, are secured to the inner surface of the shell by brazing or the like.

18 Claims, 5 Drawing Figures

COMBUSTOR LINER STRUCTURE

BACKGROUND OF THE INVENTION

This invention relates primarily to combustor chambers and, more particularly, to an air-cooled combustion liner for a gas turbine engine and a method of making the same.

Increased performance levels of gas turbine engines can be obtained by increasing the operating temperatures thereof. In so doing, the combustion chambers of these gas turbine engines are exposed to extremely high temperatures which would be destructive to the combustor apparatus unless some precautions are taken. Although there have been great improvements in liner alloys and other combustion chamber materials in order to allow higher temperature operation, a common method of enhancing combustion chamber life and dependability is to cool the combustion chamber by way of cooling air circulation.

One of the most successful methods of cooling combustor liners is that of film-surface cooling, wherein a thin layer of cooling ar is formed between the hot gases of combustion and the liner portions forming and defining the combustion chamber. Typically, the combustion chamber liner defining a combustion zone also partially defines a cool fluid plenum usually circumscribing the combustion zone. Means are commonly provided for transferring a portion of the cool fluid from the plenum into the combustion zone to form the protective film barrier on the inner surface of the combustion liner. Formed in the liner walls are a plurality of holes or slots which are axially spaced to assure that a sufficient amount of air is distributed along the entire length of the liner. The amount of cooling air which is eventually used is detrimental to combustor performance characteristics and is therefore preferably held to a minimum. This minimal use of cooling air results in acceptable liner life so long as nothing occurs in the operation thereof which would result in local or continuous interruption of the film cooling. In order to obtain effective film progagation over the entire inner surface of the liner, the air which enters the combustor liner from the surrounding plenum must be directed in such a manner as to attach to the inner surface of the liner so as to form a boundary layer without aspirating or entraining hot gases from the combustion zone. In providing the proper fluid flow direction, it has become common to utilize a relatively long, axially extending, overhanging lip to define, along with the liner inner side, a slot to properly direct the fluid flow.

One difficulty which has been experienced from the use of an overhanging lip is that a decay of the cooling film allows the slot overhang to tend to overheat, and since it is relatively thin and unsupported at its discharge end, it tends to grow radially outward so as to close off the cooling slot. This results in a reduction of cooling flow and further overheating of slot overhangs which are disposed downstream therefrom.

In order to overcome the blockage of coolant flow by thermal growth of the lip, the lip may be made of heavier material which will resist the thermal stresses resulting from the cooling film decay. However, the advantages of using heavier material for the forming of the overhanging lip may very well be offset by the disadvantages of increased weight and cost of manufacture.

It is therefore an object of the present invention to provide a combustor liner which provides a continuous, uninterrupted film of cooling air on the inner side thereof.

Another object of this invention is the provision for a combustor liner which is capable of operating under high temperature conditions over a long life period.

Yet another object of this invention is the provision for a combustor liner which is economical to fabricate and extremely effective in use.

These objects and other features and advantages will become more readily apparent upon reference to the following description when taken in conjunction with the appended drawings.

SUMMARY OF THE INVENTION

Briefly, in accordance with one aspect of the invention, a combustor liner is shown having a continuous annular shell with a plurality of axially spaced holes formed therein to conduct the flow of cooling air from a surrounding plenum to the inner side of the shell wall to form a coolant film between the wall and the enclosed combustion zone. Attached to the inner wall, at positions immediately upstream of each of the coolant entrant holes, is a machined lip which extends radially downstream to form the coolant slot to thereby direct the flow of coolant along the combustor inner wall. Each of the lips are formed of a proper thickness so as to not be substantially affected by thermal growth of the discharge end when exposed to high temperature. Lips are fabricated by an apropriate machinging method in the form of rings which are placed in close fit relationship with the outer shell and fixed in their proper position by brazing or the like.

In another aspect of this invention, the continuous outer shell is formed from sheet metal of substantially constant thickness, and the cooling holes are punched therein, to thereby minimize the weight and the manufacturing cost of the shell.

By another aspect of this invention, the continuous shell portion of the liner is formed such that that portion immediately upstream of the air holes is canted from a strictly axial disposition such that the diameter increases toward the downstream end. The canting of this portion then provides for the simple positioning of the overhang ring in a desirable close fit relationship with the shell at that point to facilitate the brazing or similar attachment thereto.

In the drawings as hereinafter described the preferred embodiment is depicted; however, various other modifications and alternate constructions can be made thereto without departing from the true spirit and scope of the invention.

DESCRIPTION OF THE PREFERRED EMBODIMENT

Figure 1:
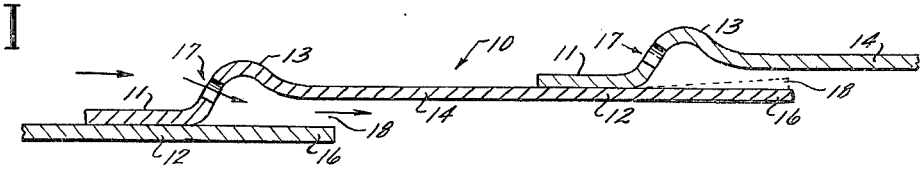
Fig 1 PRIOR ART
FIG. 1 shows a combustor liner of te stacked ring type in accordance with the prior art.

The prior art structure of the combustor liner shown in FIG. 1 is that structure commonly known as the stacked ring design, wherein short segments 10 are assembled in a progressive overlapping fashion such that the upstream end 11 of a segment overlaps a section 12 of the segment immediately upstream thereof. Each of the segments 10 is formed of a material substantially constant in thickness and comprises in downstream series connection an upstream end 11, an enlarged section 13, an intermediate section 14, an overlapped section 12 and a downstream section 16. An aperture 17 is provided in the enlarged section to conduct the flow of air from the outer side of the liner to the inner side thereof as indicated by the arrows to facilitate a film cooling of the liner. The downstream end 16 of each segment is enclosed by the enlarged section of the adjacent downstream segment such that a discharge slot 18 is formed between the segments to direct the flow of air entering the aperture 17 to continuously flow along the internal wall to therby maintain an air film between the wall and the enclosed combustion zone. As the incoming air flows along the slot toward the downstream section or overhang 16, the cooling film tends to decay and the overhang 16 therefore tends to overheat. The resulting higher temperature at the end of the overhang tends to make it grow radially outward as shown by the dotted line of FIG. 1 to thereby close off the cooling slot 18. This results in the reduction of cooling flow in the slot 18 and a further overheating of the slot overhang located downstream thereof. Solutions to this problem include the use of a dimple formed on the downstream end so as to be interposed between the overhang and the liner shell to prevent any such thermal growth, but the disadvantage to this approach is that the dimple itself tends to cause a restriction and a vortex which disrupts the continuous smooth flow of air along the inside surface.

Figure 2:
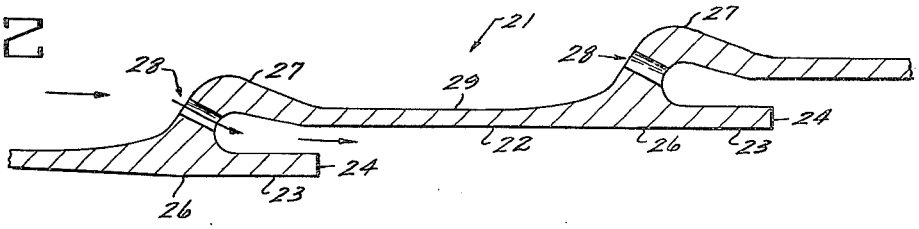
Fig 2 PRIOR ART
FIG. 2 illustrates another prior art embodiment of a combustor liner.

Referring now to FIG. 2, another prior art embodiment of a combustor liner is shown at 21 and is of the type commonly referred to as the machined ring design. It comprises a heavy forging 22 which is machined to its shape to provide preferentially thick areas to resist the thermal stresses resulting from the cooling air decay and provides preferentially thin areas for the overall control of excess engine weight. In this way, the problem of slot overhang distortion is overcome since the overhangs 23 can be made heavier to resist the thermal stresses. In particular, since the lip portion is relatively short, the entire lip from the trailing end 24 to the base 26 can be made substantially thicker than that of the stacked ring apparatus discussed hereinabove. Similarly, that enlarged portion 27 of the continuous liner in which the apertures 28 are formed, ca be made considerably thicker to provide the desired strength characteristics, while at the same time allowing the intermediate portion 29 to be made considerably thinner to reduce the overall weight of the liner.

Although the performance characteristics of the machined ring design are satisfactory, this method of fabrication is expensive since the majority of the forging used in the liner contruction must be discarded during the machining of the liner shape. Further, the machining processes which are involved, including the drilling of the apertures 28, is much more expensive than the fabrication of the individual segments shown in the prior art design of FIG. 1.

Figure 3:
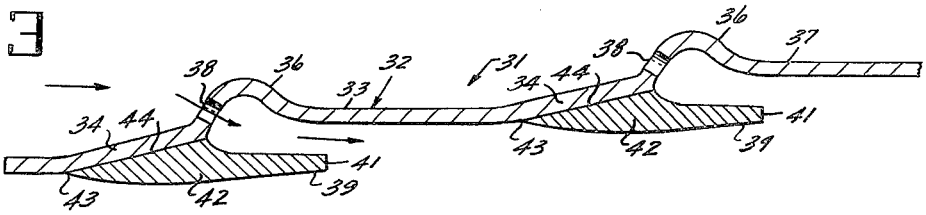
FIG. 3 is a partial longitudinal cross section of the combustor liner in accordance with the preferred embodiment of this invention.

The present invention shown generally at 31 in FIG. 3, combines the advantages of each of the prior art embodiments of FIGS. 1 and 2. Specifically, it comprises a continuous sheet metal outer shell 32 which is preferably formed from a constant thickness sheet metal into successive patterns comprising serially connected intermediate, or axial 33, transitional 34, enlarged, or cooling 36 and slot 37, portions. Cooling holes 38 can be formed in the enlarged portion 36 either before or after the forming of the shell by a simple state-of-the-art method as by punching or the like.

The overhangs 39 of the present invention are individually made, separate from the outer shell, and are connected thereto at the respective transitional portions 34. They are formed in a ring having a thickness considerably greater than that of the outer shell by way of a well-known process such as by rolling or by extrusion, thereby minimizng or eliminating the amount of discarded material as occurred in the prior art apparatus of FIG. 2.

Figure 4:
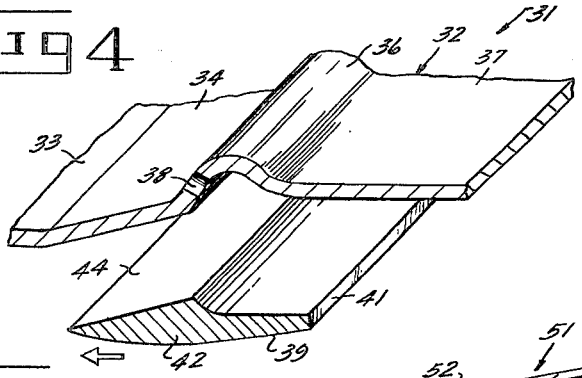
FIG. 4 is an enlarged perspective view of a portion of the present invention.

Referring to FIG. 4 wherein the shell 32 and the ring 39 are shown in separation, and to FIG. 3 wherein they are shown in the assembled positions, it can be seen that the overhang ring 39 includes and end portion 41 which together with the slot portion 37 of the shell defines the cooling slot portion 37 of the shell defines the cooling slot for directing the flow of air which is admitted by the cooling holes 38, and a base portion 42 which transists to a greater thickness and then tapers down to a point 43 to thereby present a planar surface 44 for engagement with the transitional portion of the outer shell. The transitional portion 34 is similarly formed in a plane, so that the combination can be easily assembled to provide a close fit relationship to facilitate the connecting process of brazing or the like. That is to say, unlike the stacked ring design of FIG. 1 wherein it is difficult to obtain the exact diameter in adjoining segments so as to bring about a close fit relationship, the overhang ring 39 can be moved along the plane as indicated by the arrow in FIG. 4 until the desired close fit relationship is obtained between the shell and the overhang. This will be more clearly understood when considering the overall structural characteristic of a typical combustor as shown in FIG. 5.

Figure 5:
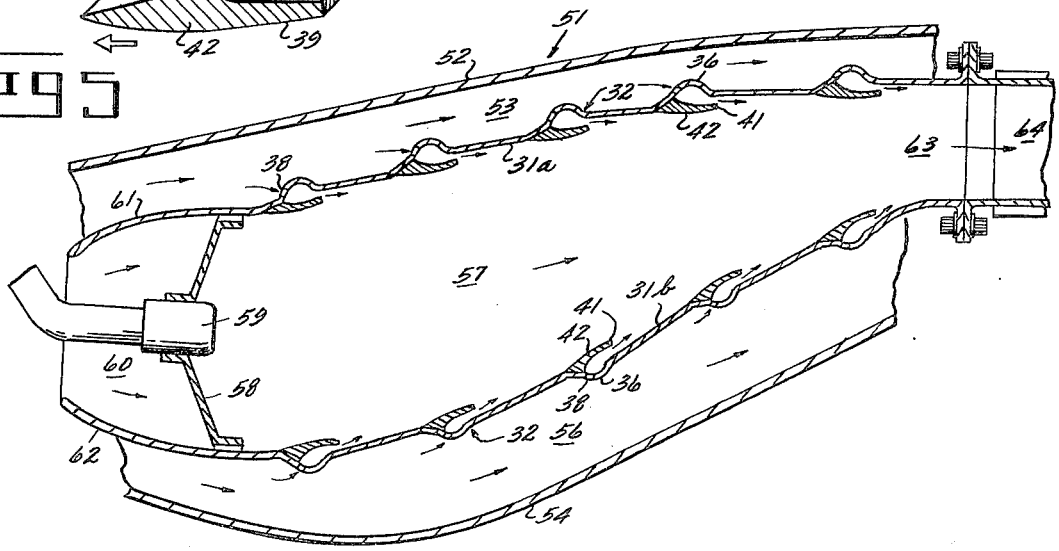
FIG. 5 is a longitudinal cross-sectional view of a combustor to which the present invention is applied.

In FIG. 5 the present invention is shown in typical annular combustion chamber 51 of the gas turbine engine variety. An outer liner 52 combines with the combustor liner 31*a* of the present invention to define an outer plenum 53. Similarly, an inner liner 54 combines with another combustor liner 31*b* of the present invention for the purpose of defining a radially inner plenum 56. The combustion zone itself is designated 57 and is defined by the liners 31*a* and 31*b* as well as by an upstream dome 58 which cooperates with the fuel nozzle 59 through which the fuel for combustion is directed into the combustion zone. An air/fuel inlet 60 is defined between axial extensions 61 and 62 of liners 31*a* and 31*b*, respectively.

Generally, the combustion chamber is of a type well known in the art and operates as follows. A flow of atmospheric air is pressurized by means of a compressor (not shown) upstream of the combustion zone 57 with the compressor discharge directed partially into the plenums 53 and 56 as well as into the fuel/air inlet 60. The quantity of fuel is mixed with a portion of the air entering fuel inlet 60 and is ignited within the combustion zone 57. The rapid expansion of the burning gases in the configuration of liners 31*a* and 31*b* results in the gases being forced from the combustion zone 57 through an outlet 63 and into engagement with the turbine 64. The rotary portions of the turbine are driven by this exciting fluid and a portion of the energy thereof serves to drive the upstream compressor through an interconnecting shaft. The remaining energy of the gas stream provides a driving thrust to the engine.

From the foregoing description of the annular type combustor, it can be seen that each of the liners 31*a* and 31*b* comprises an annular axially continuous shell 32 having a plurality of overhang rings 39 disposed therein. Each of the rings 39 can be translated axially as shown in FIG. 4 to obtain a tight fit relationship with the associated shell. Final attachment is obtained by a well-known manner such as brazing or the like.

It will be understood that although the present invention was described in terms of use with an annular combustor, it may just as well be used in a combustor of the cannular type wherein a single liner is used to define a combustion zone wherein the fuel is injected therein substantially along the axis of the combustion zone chamber. In this type of combustor there is, of course, only a single liner with a plurality of overhangs with the combination assembled in substantially the same manner as that described for each of the liners in the annular combustor.

The present invention has been described to show an improved apparatus and method for the fabrication of a combustor liner which offers desirable performance characteristics and cost savings fabrication techniques. While the concepts of this invention have been illustrated with respect to a single embodiment thereof, it is apparent that these concepts are subject to applicabilty and that numerous variations of the structure of the shown embodiment may be made by those skilled in the art without departing from the true spirit of the invention. For example, the cooling holes 38 may be formed by way of any number of methods and may comprise a plurality of circumferentially spaced holes formed in the liner Alternatively, the cooling air my be admitted to the shell by way of a continuous circumferential slot formed therein. Further, the slot portion 37 of the shell may be formed such that its alignment more closely corresponds to that of the transitional portion such that axial movement of the overhang 39 to facilitate close fit alignment will not tend to change the general size of the slot defined by the slot section and the overhang. Another variation which may be made of the structure as disclosed may be that of using a segmented approach for the overhang members rather than continuous rings as described.

What is claimed as new and desired to be secured by Letters Patent of the United States is:

1. A method of fabricating a liner defining an internal combustion chamber and adapted to be surrounded by a plenum having an axial flow of cooling fluid therein, comprising:

a. forming a continuous outer shell of axially successive patterns comprising in serial connection, an axial portion, a transition portion extending outwardly into the plenum, and an entrant portion having a plurality of aperture means for providing fluid communication between said plenum and said combustion chamber; and b. attaching to the inner surface of each of said transition portions, a slip extending in a general downstream direction to define the inner boundary of a cooling slot which directs the flow of cooling air along the inner surface of said axial portion, said lip being of an increased thickness at an intermediate section thereof sufficient to allow it to resist thermal stresses which result from cooling film decay along its length, so as to thereby prevent said cooling slot from narrowing towards its downstream end.

2. A method of fabricating a liner as set forth in claim 1 wherein said outer shell forming process includes in the step of forming an entrant portion, the additional step of forming an enlarged portion, so as to extend said shell outwardly into said plenum to increase the flow of cooling air in said aperture means.

3. A method of fabricating a liner as set forth in claim 1 wherein said aperture means is formed by way of punching holes in said continuous outer shell.

4. A method of fabricating a liner as set forth in claim 1 wherein, in the process of forming said outer shell, said transition portion is formed in a substantially planar shape.

5. A method of fabricating a liner as set forth in claim 4 wherein said transition portion is aligned at an acute angle with respect to the plane of the adjoining upstream axial portion.

6. A method of fabricating a liner as set forth in claim 5 and including the step of translating said lip within said shell, in the upstream direction until a close fit relationship is established between the lip and said transition portion.

7. A method of fabricating a liner as set forth in claim 1 wherein said outer shell is formed of a constant thickness material.

8. A method of fabricating a liner as set forth in claim 1 wherein said shell is annular in shape and said lips comprise rings which are disposed therein.

9. An improved combustion chamber of the type disposed in an air-cooled plenum and adapted to receive a fuel mixture in one end and discharge a hot gas from the other end wherein the improvement comprises:

a. a continuous annular liner of substantially constant thickness and having axially successive patterns comprising in serial connection, an axial portion, a transition portion extending outwardly into the plenum, and an entrant portion having a plurality of circumferentially spaced aperture means for providing fluid communication between said plenum and said combustion chamber; and b. a plurality of rings attached to the inner surface of said liner, each ring being attached to one of said transition portions and extending in a general downstream direction to define the inner boundary of a cooling slot which directs the flow of cooling air along the inner surface of an axial portion of the liner, each of said rings being of a thickness sufficient to allow it to resist thermal stresses which result from cooling film decay along its length, so as to thereby prevent said cooling slot from narrowing towards its downstream end.

10. An improved combustion chamber as set forth in claim 9 wherein said cooling portion comprises an enlarged section extending outwardly into said plenum to enhance the flow of cooling air into said aperture means.

11. An improved combustion chamber as set forth in claim 9 wherein a portion of said ring is tapered between an intermediate point and the downstream end thereof.

12. An improved combustion chamber as set forth in claim 9 wherein said ring is tapered from an intermediate point to the upstream end thereof, to define a planar surface to abut the inner surface of said shell.

13. An improved combustion chamber as set forth in claim 9 wherein said liner transition portion is substantially planar at its inner surface.

14. An improved combustion chamber as set forth in claim 13 wherein said planar portion is canted radially outward towards its downstream end.

15. An improved combustion chamber as set forth in claim 9 wherein said aperture means comprises a plurality of cicumferentially spaced holes which are aligned to impinge air on said rings.

16. A method of fabricating a liner as set forth in claim 6 and including the additional step of welding said lip to said transition portion.

17. An improved combustion chamber as set forth in claim 9 wherein said ring tapers down in thickness from an intermediate point to the downstream end thereof.

18. An improved combustion chamber as set forth in claim 9 wherein said ring tapers down in thickness from an intermediate point to the upstream end thereof.

* * * * *